US010982455B2

(12) United States Patent
Wang et al.

(10) Patent No.: US 10,982,455 B2
(45) Date of Patent: Apr. 20, 2021

(54) SMALL MOBILE SPACE

(71) Applicant: Halumm Construction Technology Co., Ltd., Hangzhou (CN)

(72) Inventors: Xiaodong Wang, Hangzhou (CN); Huajun Shan, Hangzhou (CN); Bingjun Lian, Hangzhou (CN); Zhoujing Xu, Hangzhou (CN); Lidong Lin, Hangzhou (CN); Anming Li, Hangzhou (CN); Shanxiang Zhuang, Hangzhou (CN)

(73) Assignee: Halumm Construction Technology Co., Ltd., Hangzhou (CN)

( * ) Notice: Subject to any disclaimer, the term of this patent is extended or adjusted under 35 U.S.C. 154(b) by 0 days.

(21) Appl. No.: 16/441,677

(22) Filed: Jun. 14, 2019

(65) Prior Publication Data

US 2020/0340261 A1 Oct. 29, 2020

(51) Int. Cl.

| | |
|---|---|
| ***E04H 1/12*** | (2006.01) |
| ***E04B 1/82*** | (2006.01) |
| ***E04C 2/02*** | (2006.01) |
| ***E04C 2/52*** | (2006.01) |
| ***A47B 21/06*** | (2006.01) |
| ***E04C 2/00*** | (2006.01) |
| ***A47B 5/00*** | (2006.01) |

(52) U.S. Cl.

CPC ..... *E04H 1/125* (2013.01); *E04B 1/8218* (2013.01); *E04C 2/02* (2013.01); *E04C 2/523* (2013.01); *E04H 1/1205* (2013.01); *A47B 5/00* (2013.01); *A47B 21/06* (2013.01); *A47B 2021/066* (2013.01); *E04C 2002/005* (2013.01)

(58) Field of Classification Search

CPC ..... E04H 1/1205; E04H 1/125; E04B 1/8218; E04C 2/02; E04C 2/523; E04C 2002/005; A47B 2021/066; A47B 21/06; A47B 5/00

See application file for complete search history.

(56) References Cited

U.S. PATENT DOCUMENTS

| | | | | |
|---|---|---|---|---|
| 5,197,921 | A * | 3/1993 | De Lank | E04B 1/8218 181/211 |
| 6,250,022 | B1 * | 6/2001 | Paz | E04B 1/34321 312/100 |
| 9,003,737 | B2 * | 4/2015 | Solomon | E04B 2/7453 52/270 |
| 9,617,727 | B2 * | 4/2017 | Saunier | A61M 21/0094 |

(Continued)

*Primary Examiner* — Andrew J Triggs

(74) *Attorney, Agent, or Firm* — Dragon Sun Law Firm, PC; Jinggao Li, Esq.

(57) ABSTRACT

A small mobile space includes a top plate, a bottom plate, and wall modules between the top plate and the bottom plate and is connected in sequence. The top plate, the bottom plate and the wall modules jointly define an accommodating space. A door assembly is arranged on at least one of the wall modules. A joint between every two adjacent wall modules, a joint between each wall module and the top plate, as well as a joint between the bottom plate and each of wall modules are clamped respectively by using a concave-convex structure. An air inlet module is arranged in the top plate and includes an air inlet channel, and a sound absorption component in the air inlet channel. An air inlet of the air inlet channel is communicated to the outside. An air outlet of the air inlet channel is communicated with the accommodating space.

16 Claims, 9 Drawing Sheets

(56) References Cited

U.S. PATENT DOCUMENTS

| | | | | |
|---|---|---|---|---|
| 9,784,469 | B2 * | 10/2017 | Ramos | F24F 13/24 |
| 9,797,153 | B2 * | 10/2017 | Baggiero, II | E04H 9/06 |
| 10,017,953 | B2 * | 7/2018 | Baggiero, II | E04H 9/10 |
| 10,094,102 | B2 * | 10/2018 | Blocker | E04B 1/1903 |
| 2004/0045225 | A1 * | 3/2004 | Weiss | E04B 2/7425 52/36.1 |
| 2007/0125011 | A1 * | 6/2007 | Weir | E04B 2/7409 52/144 |
| 2013/0086860 | A1 * | 4/2013 | Solomon | E04B 2/7453 52/243.1 |
| 2014/0116870 | A1 * | 5/2014 | Kamen | E04H 1/1205 202/83 |
| 2017/0356182 | A1 * | 12/2017 | Caffaratti Giro | E04B 1/8218 |
| 2019/0112801 | A1 * | 4/2019 | Suzuki | E04B 1/3445 |

* cited by examiner

SMALL MOBILE SPACE

CROSS-REFERENCE TO RELATED APPLICATION

This application claims priority from CN Application No. 2019205682611, filed Apr. 24, 2019, the content of which is incorporated herein in the entirety by reference.

Some references, which may include patents, patent applications, and various publications, are cited and discussed in the description of the present disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

TECHNICAL FIELD

The present application relates to the technical field of small space products, and in particular relates to a small mobile space.

BACKGROUND

Small space products are widely used in public spaces, especially in noisy indoor spaces such as offices, airports, service halls, and hospital halls. The small space product is equipped with tables and chairs, USB charging interfaces or power sockets, lighting and other infrastructures in combination with people's current behavior habits, and may be configured with access control, video dialogue, touch dimming, etc. In the future market environment, more and more attention will be paid to personalized private spaces, which have been or will be extended to baby-care rooms, lounges, live rooms, karaoke rooms, prayer rooms, dressing rooms and the like.

At present, products on the market are weak in sound insulation, resulting in a mutual interference inside and outside, which is specifically manifested in an inappropriate selection of materials, insufficient sealability at a joint between a surface and another surface or a too short path through which sound passes. An air passage for air intake and air discharge is too short to produce a satisfactory sound insulation effect, which is specifically manifested in that air intake and air discharge at the top happen in the same vertical position, with only one steel baffle being suspended therebetween, such that sound can easily penetrate and the sound insulation effect of a top module is deteriorated. Sound of a fan also is generated, and thus the internal sound is too large in use.

The installation is time-consuming, and accompanied with poor replaceability in a decorative finish of a finished product. It is impossible to increase or decrease other functional configurations on the basis of the finished product. It is specifically manifested in that a mode of disassembling parts after production requires a customer to install on site, and these parts cannot be prefabricated or integrated into as few parts as possible based on respective installation modes. The variety of installation modes requires a lot of tools and professional workers to assist with the installation. The customer needs many installation procedures and takes a long time, thereby causing an increase in the labor cost.

The recycling rate is low, which is specifically manifested in that the used main materials are mostly non-renewable materials. Most of products on the market use wood products as main bodies, but the recycling rate of wood is lower. Faced with wood resource shortage and environmental pressures, as well as huge wood conservation and substitution potential, to develop wood conservation and substitution, and to build ecological harmony, the implementation of Four Major Projects (including the wood processing machinery numerical control project, the wood protection project, the waste wood recycling industrialization project, and the environment-friendly wood-based project) of wood conservation and substitution can be accelerated.

Through market research and prediction for future markets, it is necessary to design a small space which has good sound insulation, and is modularly disassembled and assembled, environment-friendly and highly-efficient.

Therefore, a heretofore unaddressed need exists in the art to address the aforementioned deficiencies and inadequacies.

SUMMARY

An objective of the present disclosure is to provide a small mobile space, which saves the installation time and reduces the installation difficulty by means of a modular disassembling and assembling design. A special connection mode between walls, as well as a design of an air outlet channel and an air inlet channel makes the product soundproof efficiently, thereby avoiding a mutual interference inside and outside. In addition, a replaceable decorative finish is further installed on the outer side of the respective wall. Therefore, the small mobile space is environment-friendly and highly-efficient.

To solve the above-mentioned problem, according to one aspect of the present utility model, the present disclosure provides a small mobile space, which comprises a top plate, a bottom plate, and a plurality of wall modules which is arranged between the top plate and the bottom plate and is connected in sequence, wherein the top plate, the bottom plate and the plurality of wall modules jointly define an accommodating space; a door assembly is arranged on at least one of the wall modules; a joint between every two adjacent wall modules, a joint between each wall module and the top plate, as well as a joint between the bottom plate and each of the plurality of wall modules are clamped respectively by using a concave-convex structure; an air inlet module is arranged in the top plate, and comprises an air inlet channel having a preset length, and a sound absorption component arranged in the air inlet channel; an air inlet of the air inlet channel is communicated to the outside; an air outlet of the air inlet channel is communicated with the accommodating space; and a mobile assembly is arranged on the bottom plate, such that the accommodating space is movable and can be fixed at a preset position.

Further, a groove is formed in one side, close to the top plate, of the wall module, and a bulge whose shape is matched with that of the groove is arranged on the top plate; a groove is formed in one side, close to the bottom plate, of the wall module, and a bulge whose shape is matched with that of the groove is arranged on the bottom plate; and for every two adjacent wall modules, a groove is formed in one of the two adjacent wall modules, and a bulge whose shape is matched with that of the groove is arranged on the other wall module.

Further, the air inlet module further comprises an air supply component which is arranged at the air inlet of the air inlet channel to suck outside air into the air inlet channel.

Further, an air outlet module is arranged on at least one of the wall modules, and comprises an air outlet channel having a preset length, and a sound absorption component arranged in the air outlet channel; and the air inlet of the air outlet channel is communicated with the accommodating space, and the air outlet of the air outlet channel is communicated to the outside.

Further, the air outlet channel extends in a width direction or in a height direction of the wall module.

Further, a corner post is arranged at a corner position of the bottom plate; an insertion slot whose shape is matched with that of the corner post is formed at a joint between the wall module and the corner post; and the insertion slot cooperates with the corner post, such that the wall module is in inserted connection with the bottom plate.

Further, at least one detachable decorative plate is arranged on the outer side of the top plate; at least one detachable decorative plate is installed on the outer side of at least one of the wall modules, which is not provided with the door assembly; and at least one detachable decorative plate is arranged on the outer side of the door assembly.

Further, at least one elastic connector is arranged on the outer side of the wall module, wherein one end, close to the elastic connector, of the decorative plate is configured as a folded structure, and the folded structure is inserted into the elastic connector.

Further, at least one locking hole is formed in the outer side of the wall module, and a lock catch which is matched with the locking hole is arranged on one side, close to the wall module, of the decorative plate; or at least one lock catch is formed on the outer side of the wall module, and a locking hole which is matched with the lock catch is formed in one side, close to the wall module, of the decorative plate.

Further, the small mobile space further comprises a connector, wherein at least one locking hole is formed in the inner side of the wall module, and a decorative plate locking hole which corresponds to the locking hole is formed in one side, close to the wall module, of the decorative plate; and the connector passes through the locking hole and the decorative plate locking hole in sequence to detachably connect the wall module and the decorative plate.

Further, at least one detachable decorative finish is arranged on the inner side of the top plate; at least one detachable decorative finish is installed on the inner side of at least one of the wall modules, which is not provided with the door assembly; at least one detachable decorative finish is arranged on the inner side of the door assembly.

Further, a glass module is arranged on at least one of the wall modules.

Further, a sound absorption component is arranged on at least one of the wall modules.

Further, the small mobile space further comprises a table in which a first circuit system and a power socket are arranged; the table is detectably connected to at least one of the wall modules; a mains supply is respectively connected to the first circuit system and the power socket; and the first circuit system converts the mains supply to a DC of 12 v.

Further, a second circuit system is further arranged inside at least one of the wall modules; one end of the second circuit system is connected to the first circuit system, and the other end of the second circuit system is arranged in the top plate so as to supply the converted DC of 12 v to a lighting device and the air inlet module in the top plate.

Further, the small mobile space further comprises an induction switch; and the induction switch is arranged on at least one of the wall modules or the table, and is connected to the second circuit system to switch on or switch off the second circuit system.

An objective of the present disclosure is to provide a small mobile space, which comprises a top plate, a bottom plate, and a plurality of wall modules which is arranged between the top plate and the bottom plate and is connected in sequence, wherein the top plate, the bottom plate and the plurality of wall modules jointly define an accommodating space; a door assembly is arranged on at least one of the wall modules; a joint between every two adjacent wall modules, a joint between each wall module and the top plate, as well as a joint between the bottom plate and each of the plurality of wall modules are clamped respectively by using a concave-convex structure; an air inlet module is arranged in the top plate, and comprises an air inlet channel having a preset length, and a sound absorption component arranged in the air inlet channel; an air inlet of the air inlet channel is communicated to the outside; an air outlet of the air inlet channel is communicated with the accommodating space; and a mobile assembly is arranged on the bottom plate, such that the accommodating space is movable and can be fixed at a preset position. The small mobile space saves the installation time and reduces the installation difficulty by means of a modular disassembling and assembling design. A special connection mode between walls, as well as a design of the air outlet channel and the air inlet channel makes the product soundproof efficiently, thereby avoiding a mutual interference inside and outside. In addition, a replaceable decorative finish is further installed on the outer side of the respective wall. Therefore, the small mobile space is environment-friendly and highly-efficient.

The above-mentioned technical solution of the present disclosure has the following technical effects.

The concave-convex groove is adopted at the joint between the walls, such that a path through which sound passes is longer, accompanied with good sealability. The inlet air channel has a longer path, so that sound cannot penetrate easily. In addition, the air inlet channel is further filled with a sound absorption material to improve the sound insulation of a top module. The air outlet channel is set to have a lateral path, and the lateral air outlet channel increases the length of sound propagation and the number of sound wave reflections so as to weaken the sound. Meanwhile, the air outlet channel is also filled with a sound absorption material for secondary weakening of the sound.

A sound absorption felt is further arranged in each wall to maximize the sound insulation.

Various modules in the small mobile space of the present disclosure are prefabricated in a factory, thereby implementing modular installation, saving the installation time of a customer and reducing the installation difficulty. Meanwhile, the small mobile space is also convenient to disassemble and assemble, and is flat and firm. The decorative finish is replaceable and recyclable.

BRIEF DESCRIPTION OF THE DRAWINGS

The accompanying drawings illustrate one or more embodiments of the present invention and, together with the written description, serve to explain the principles of the invention. Wherever possible, the same reference numbers are used throughout the drawings to refer to the same or like elements of an embodiment.

REFERENCE NUMERALS

1-top plate; 2-bottom plate; 3-wall module; 4-door assembly; 5-decorative plate; 6-table; 7-nut; 8-decorative finish; 11-air inlet channel; 12-air inlet of the air inlet channel; 13-air outlet of the air inlet channel; 14-air supply component; 15-lighting device; 16-circuit; 21-mobile assembly; 22-corner post; 31-air outlet channel; 32-air inlet of the air outlet channel; 33-air outlet of the air outlet channel; 34-insertion slot; 35-locking hole; 36-bolt; 37-elastic connector; 38-glass module; 39-decorative cover; 41-door frame; 51-folded structure; and 61-installing hole; 91-groove; 92-bulge.

DETAILED DESCRIPTION

In order to make the objects, technical solutions and advantages of the present disclosure clearer, the present disclosure will be further described in detail below with reference to specific embodiments and the accompanying drawings. It should be understood that these descriptions are merely exemplary, and are not intended to limit the scope of the present utility model. Moreover, the descriptions of well-known structures and techniques are omitted in the following description in order to avoid unnecessary confusion in the concept of the present utility model.

The present disclosure will be described in detail below with reference to the accompanying drawings and embodiments.

Figure 1:
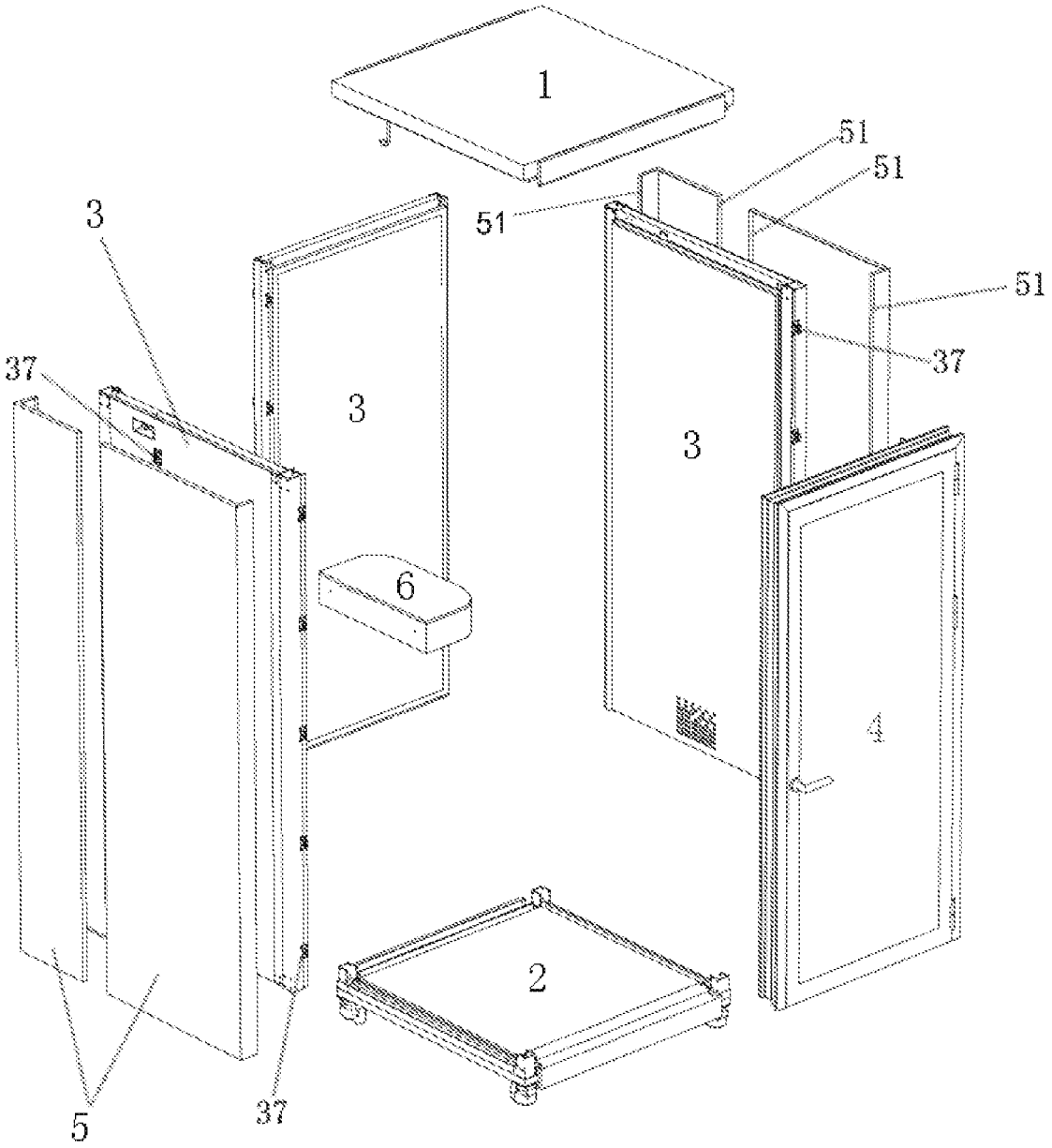
FIG. 1 is an exploded structural diagram of a small mobile space provided by the present utility model.

FIG. 1 is an exploded structural diagram of a small mobile space provided by the present utility model.

Figure 2:
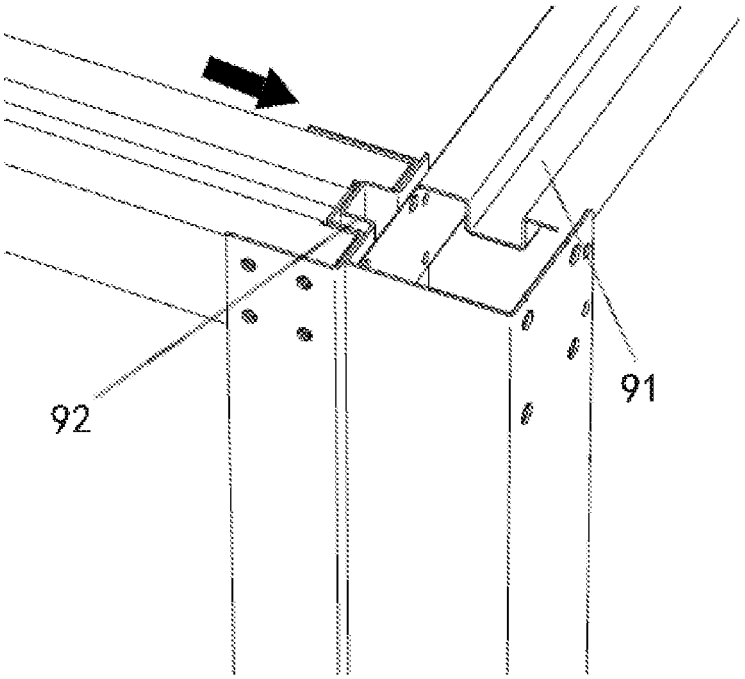
FIG. 2 is a schematic diagram of a concave-convex structure provided by the present utility model.

FIG. 2 is a schematic diagram of a concave-convex structure provided by the present utility model.

The present disclosure provides a small mobile space. The small mobile space comprises a top plate 1, a bottom plate 2, and a plurality of wall modules 3 which is arranged between the top plate 1 and the bottom plate 2 and is connected in sequence. The top plate 1, the bottom plate 2 and the plurality of wall modules 3 jointly define an accommodating space. A door assembly 4 is arranged on at least one of the wall modules 3. A joint between every two adjacent wall modules 3, a joint between each wall module 3 and the top plate 1, as well as a joint between the bottom plate 2 and each of the plurality of wall modules 3 are clamped respectively by using a concave-convex structure.

An air inlet module is arranged in the top plate 1, and comprises an air inlet channel 11 having a preset length, and a sound absorption component arranged in the air inlet channel 11. An air inlet 12 of the air inlet channel is communicated to the outside. An air outlet 13 of the air inlet channel is communicated with the accommodating space. A mobile assembly 21 is arranged on the bottom plate 2, such that the accommodating space is movable and can be fixed at a preset position.

Specifically, in this embodiment, the small mobile space comprises three wall modules 3 and a door assembly 4, wherein a joint between every two adjacent wall modules 3, a joint between each of the three wall modules 3 and the top plate 1, a joint between each of the three wall modules 3 and the bottom plate 2, a joint between the door assembly 4 and the adjacent wall modules 3, a joint between the door assembly 4 and the top plate 1, as well as a joint between the door assembly 4 and the bottom plate 2 are clamped respectively by a concave-convex structure. Thus, a winding sound channel can be formed at each joint, thereby lengthening paths of sound transmission.

Steel frames of the above three wall modules 3, one door assembly 4, the top plate 1 and the bottom plate 2 are all prefabricated in a factory, and then modularly installed, which can save the installation time of the customer and reduce the installation difficulty.

In this embodiment, the length of the air inlet channel 11 in the air inlet module is increased to have the longer length of sound propagation and weaken the sound transmission. Meanwhile, the air inlet channel 11 is further filled with a sound absorption component to absorb sound, thereby further weakening the sound and optimize the effect of sound insulation.

In one embodiment, an air inlet plate provided with a plurality of air inlet holes is arranged at an air outlet 13 of the air inlet channel.

In one embodiment, the sound absorption component is made of a sound absorption material.

In one embodiment, the sound absorption component includes, but is not limited to a concave-convex sound absorption cotton, so as to maximize sound absorption.

Specifically, the bottom plate 2 mainly comprises a main wall provided with a mobile assembly 21. A sound absorption component is further arranged on the inner side of the main wall.

In one embodiment, the shape of the sound absorption component may be adjusted according to an installation position.

In one embodiment, the mobile component 21 is a roller on which a locking component is arranged. The roller is locked by the locking component to fix the accommodating space at a preset position.

In this embodiment, a groove is formed in one side, close to the top plate 1, of the wall module 3, and a bulge whose shape is matched with that of the groove is arranged on the top plate 1. A groove is formed in one side, close to the bottom plate 2, of the wall module 3, and a bulge whose shape is matched with that of the groove is arranged on the bottom plate 2. For every two adjacent wall modules 3, a groove is formed in one of the two adjacent wall modules 3, and a bulge whose shape is matched with that of the groove is arranged on the other wall module 3.

Specifically, sound is transmitted by means of a medium, and the medium vibrates to generate waves which are then transmitted to human ears, and thus people hear a sound. In this embodiment, the concave-convex structure which is different from a direct connection is used to lengthen the paths of sound transmission. When the concave-convex structures are spliced, the path of sound transmission is winding, thereby increasing the reflection of waves, weakening the amount of the waves transmitted to the ear, and achieving a sound insulation or sound elimination effect. The concave-convex structures not only attenuate the sound to achieve the sound insulation effect, but also can play a position effect on the installation between the modules.

In one embodiment, in case of connection using the concave-convex structures, it is no longer necessary to lock the concave-convex structures each other with screws, and therefore, the installation time of the customer can be saved.

Figure 3:
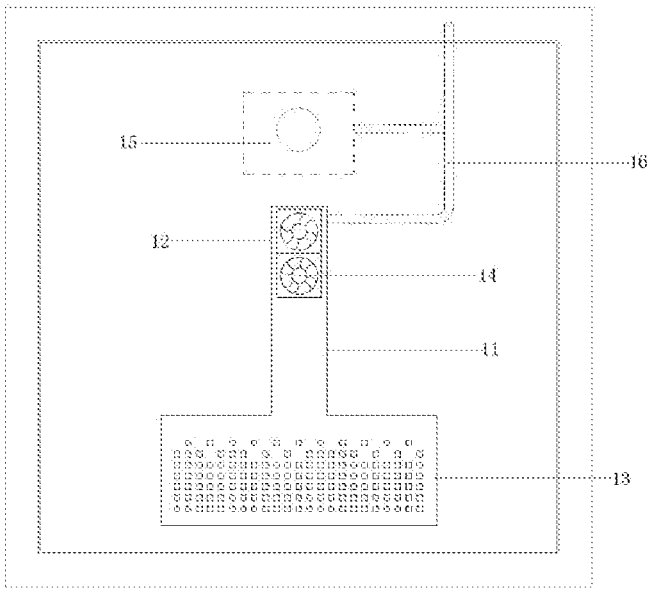
FIG. 3 is a schematic diagram of an air inlet module provided by the present utility model.

FIG. 3 is a schematic diagram of an air inlet module provided by the present utility model.

In this embodiment, the air inlet module further comprises an air supply component 14 which is arranged at an air inlet 12 of the air inlet channel to suck outside air into the air inlet channel 11.

Specifically, referring to FIG. 3, the air supply component 14 sucks outside air into the air inlet channel 11, and the outside air enters the air outlet 13 of the air inlet channel through the air inlet channel 11, thereby entering the accommodating space.

Figure 4:
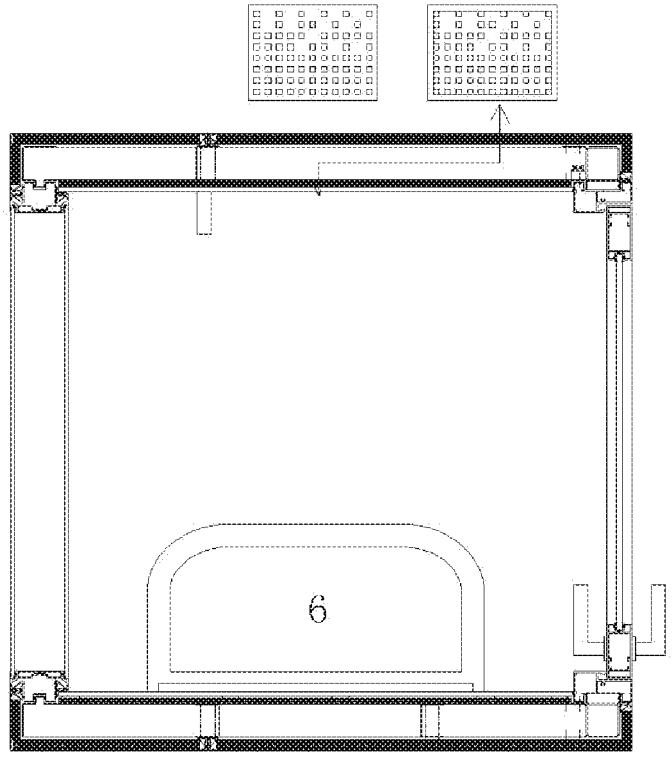
FIG. 4 is a top view of the small mobile space provided by the present utility model.
Figure 5:
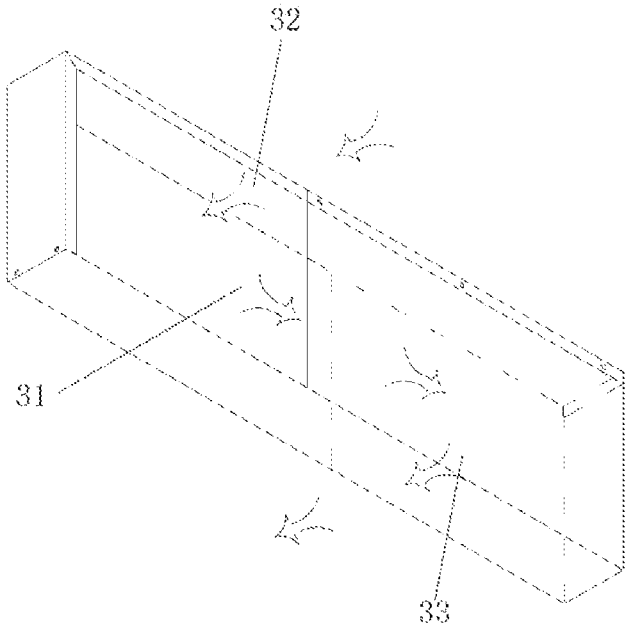
FIG. 5 is a schematic diagram of an air outlet module provided by the present utility model.

FIG. 4 is a top view of the small mobile space provided by the present utility model. FIG. 5 is a schematic diagram of an air outlet module provided by the present utility model.

In this embodiment, an air outlet module is arranged on at least one of the wall modules 3, and comprises an air outlet channel 31 having a preset length, and a sound absorption component arranged in the air outlet channel 31. The air inlet 32 of the air outlet channel is communicated with the accommodating space, and the air outlet 33 of the air outlet channel is communicated to the outside.

In this embodiment, the air outlet channel 31 extends in a width direction or in a height direction of the wall module 3.

In one embodiment, referring to FIG. 4 and FIG. 5, the air outlet channel 31 is laterally arranged in the wall module 3. An air inlet 32 of the air outlet channel and an air outlet 33 of the air outlet channel are spaced apart by a predetermined distance in a width direction, thereby increasing the length of sound propagation and the number of sound wave reflections.

In one embodiment, the air outlet channel 31 is longitudinally arranged in the wall module 3. The air inlet 32 of the air outlet channel and the air outlet 33 of the air outlet channel are spaced apart by a predetermined distance in a height direction, thereby increasing the length of sound propagation and the number of sound wave reflections.

In one embodiment, the air outlet channel 31 is obliquely arranged in the wall module 3. The air inlet 32 of the air outlet channel and the air outlet 33 of the air outlet channel are spaced apart by a predetermined distance in an inclination direction, thereby increasing the length of sound propagation and the number of sound wave reflections.

Air in the internal circulation of the small space of the present disclosure is discharged passively. The air inlet is formed in the top plate 1; the air outlet is located in the wall module 3; and the wall module 3 is provided with a lateral internal air channel which is filled with the concave-convex sound absorption cotton.

Figure 6:
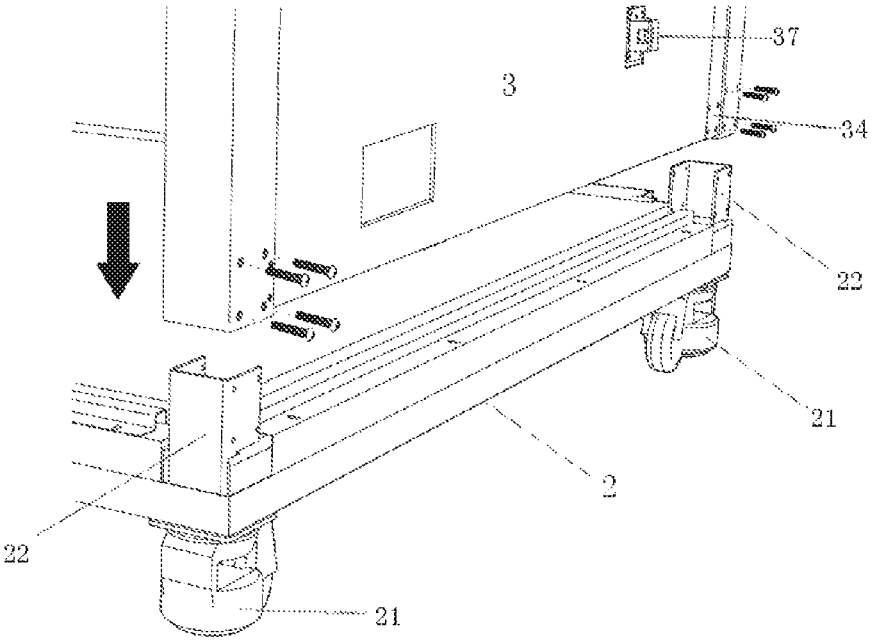
FIG. 6 is a schematic diagram in which a wall module is connected to a bottom plate provided by the present utility model.

FIG. 6 is a schematic diagram in which the wall module is connected to the bottom plate provided by the present utility model.

In this embodiment, a corner post 22 is arranged at a corner position of the bottom plate 2. An insertion slot 34 whose shape is matched with that of the corner post 22 is formed at a joint between the wall module 3 and the corner post 22. The insertion slot 34 cooperates with the corner post 22, such that the wall module 3 is in inserted connection with the bottom plate 2.

Specifically, the four corner posts 22 of the bottom plate 2 are in inserting connection manner with the wall module 3.

In one embodiment, referring to FIG. 6, the wall module 3 and the bottom plate 2 are fastened by screws after being in inserted connection with each other. However, the present disclosure is not limited thereto, and other fasteners may be used for fastening.

Figure 7:
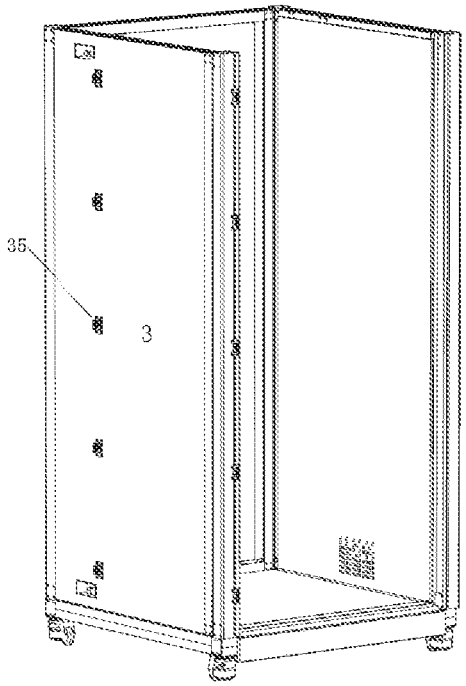
FIG. 7 is a schematic diagram of the small mobile space, on which no decorative plate is installed, provided by the present utility model.
Figure 8:
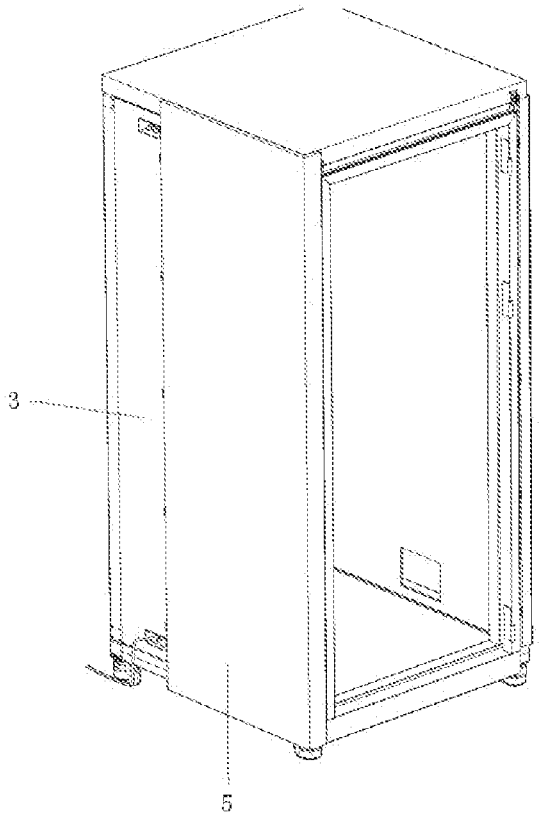
FIG. 8 is an installation diagram of the decorative plate according to a first embodiment of the present utility model.

FIG. 7 is a schematic diagram of the small mobile space, on which no decorative plate is installed, provided by the present utility model. FIG. 8 is an installation diagram of the decorative plate provided by the present utility model.

In this embodiment, at least one detachable decorative plate 5 is arranged on the outer side of the top plate 1. At least one detachable decorative plate 5 is installed on the outer side of at least one of the wall modules 3, which is not provided with the door assembly 4. At least one detachable decorative plate 5 is arranged on the outer side of the door assembly 4.

Specifically, the wall module 3 mainly comprises a main wall, and meanwhile, the decorative plate 5 is detachably installed on the outer side of the main wall. Preferably, two decorative plates 5 are used, one of which is relatively light in weight and relatively small in size relative to the other decorative plate 5. The decorative plate 5 which is relatively light in weight and relatively small in size is convenient for a user to disassemble, by facilitating the detection and maintenance of a circuit. The detachable decorative plates 5 are also convenient to disassemble and assemble, are flat and firm, and replaceable and recyclable.

In this embodiment, at least one elastic connector 37 is arranged on the outer side of the wall module 3. One end, close to the elastic connector 37, of the decorative plate 5 is configured as a folded structure 51. The folded structure 51 is inserted into the elastic connector 37.

Figure 9:
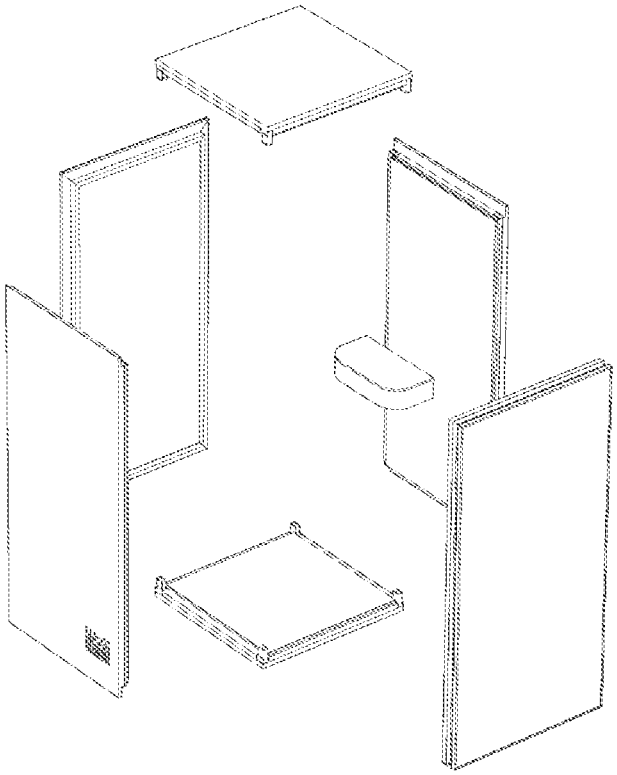
FIG. 9 is an installation diagram of the decorative plate according to Embodiment 2 of the present utility model.

Specifically, referring to FIG. 9, two decorative plates 5 are included in this embodiment. In this case, each of the wall module 3 and two ends thereof is provided with the elastic connector 37. Two ends of each of the two decorative plates 5 are configured as the folded structure 51 respectively. When the folded structures 51 at the two ends of the respective decorative plate 5 are inserted into the elastic connectors 37, the elastic connectors 37 are elastically expanded. After the folded structures 51 at the two ends of the respective decorative plate 5 are inserted into the elastic connectors 37, the elastic connectors 37 are elastically contracted, thereby connecting the decorative plate 5 to the wall module 3.

When one decorative plate 5 is included in this embodiment, the elastic connectors 37 are arranged at the two ends of the wall module 3, and the two ends of the decorative plate 5 are configured as folded structures 51.

In this embodiment, at least one locking hole is formed in the outer side of the wall module 3, and a lock catch which is matched with the locking hole is arranged on one side, close to the wall module 3, of the decorative plate 5; or at least one lock catch is formed on the outer side of the wall module 3, and the locking hole which is matched with the lock catch is formed in one side, close to the wall module 3, of the decorative plate 5.

In one embodiment, locking holes which are arranged in sequence are formed in the outer side of the wall module 3. Lock catches which are arranged in sequence and are matched with the locking holes are arranged on one side, close to the wall module 3, of the decorative plate 5. The use of a tightly-spliced locking method makes the installation flatter and firmer.

In one embodiment, lock catches which are arranged in sequence are arranged on the outer side of the wall module 3. Locking holes which are arranged in sequence and are matched with the lock catches are formed in one side, close to the wall module 3, of the decorative plate 5. The use of a tightly-spliced snap-locking method makes the installation flatter and firmer.

In this embodiment, the small mobile space further comprises a connector, wherein at least one locking hole is formed in the inner side of the wall module 3, and a decorative plate locking hole which corresponds to the locking hole is formed in one side, close to the wall module 3, of the decorative plate 5. The connector passes through the locking hole and the decorative plate locking hole in sequence to detachably connect the wall module 3 and the decorative plate 5.

Specifically, referring to FIG. 9, in this embodiment, the decorative plate locking hole in the decorative plate 5 does not penetrate through the decorative plate 5, such that the connector is not visible from the outside of the decorative plate 5.

In one embodiment, a connection mode between the connector and the locking hole and a connection mode between the connector and the decorative plate locking hole are of threaded connection.

Figure 14:
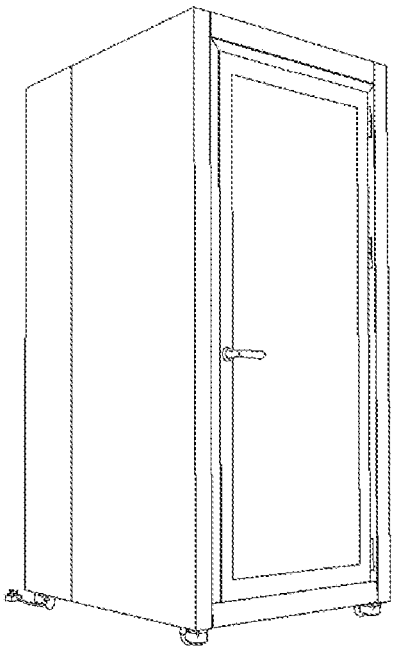
FIG. 14 is a schematic diagram in which a mains supply is connected to an accommodating space provided by the present utility model.

In one embodiment, referring to FIG. 14, in this embodiment, the bottom of the bottom plate 2 is provided with a through hole through which a mains supply enters the accommodating space, to supply an electric energy to the accommodating space.

In this embodiment, at least one detachable decorative finish 8 is arranged on the inner side of the top plate 1. At least one detachable decorative finish 8 is installed on the inner side of at least one of the wall modules 3, which is not provided with the door assembly 4. At least one detachable decorative finish 8 is arranged on the inner side of the door assembly 4.

Specifically, the decorative finish 8 in this embodiment is arranged on the inner side of each of the top plate 1, the wall module 3 and the door assembly 4.

In one embodiment, the decorative finish 8 is fixed in a buckling or magnetically attracting manner.

In this embodiment, a glass module is arranged on at least one of the wall modules 3.

Figure 10:
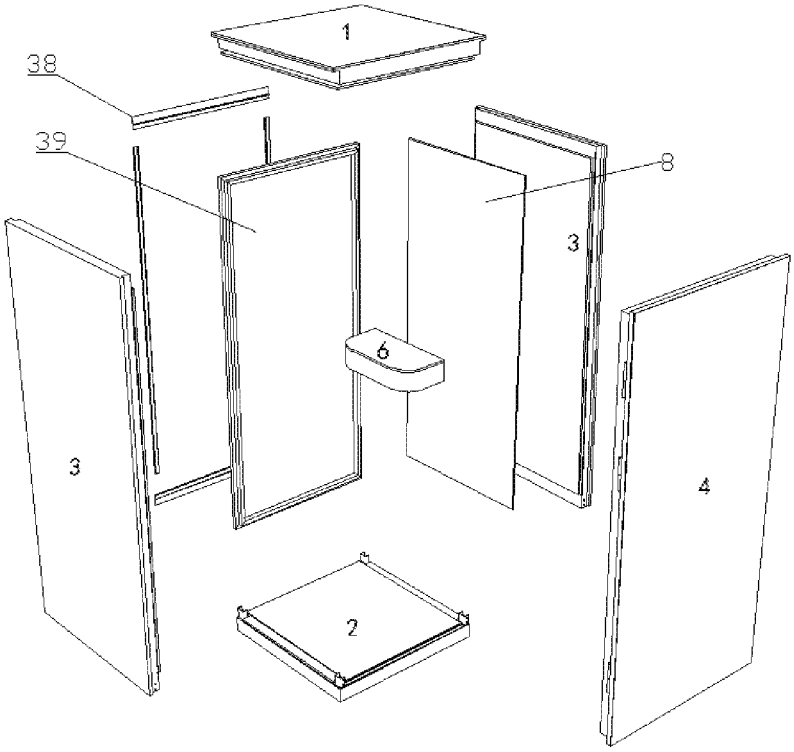
FIG. 10 is a structural diagram in which the wall module is a glass module provided by the present utility model.

Specifically, referring to FIG. 10, the wall module 3 mainly comprises a main frame in which a glass module 38 is installed. After the glass module 38 is installed, a decorative cover 39 is installed. Whether the mobile space is in use or not can be directly seen from the glass module 38, thereby satisfying different demands of customers.

In one embodiment, a circle of tightly-spliced lock catches is arranged on the main frame. Tightly-spliced lock catch members which are matched with the tightly-spliced lock catches are arranged on glass, such that the glass is installed on the main frame.

Figure 11:
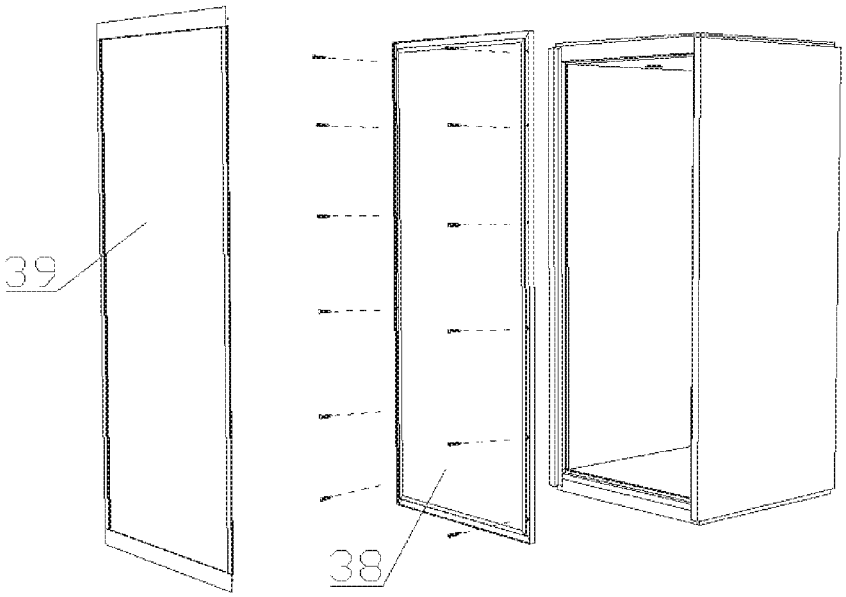
FIG. 11 is a detailed structural diagram in which the wall module is a glass module provided by the present utility model.

Preferably, referring to FIG. 11, a circle of threaded holes is formed in the main frame. The glass module 38 is provided with corresponding threaded holes, such that the glass module 38 is installed on the main frame through screws.

In this embodiment, a glass module is arranged on the door assembly 4.

Figure 12:
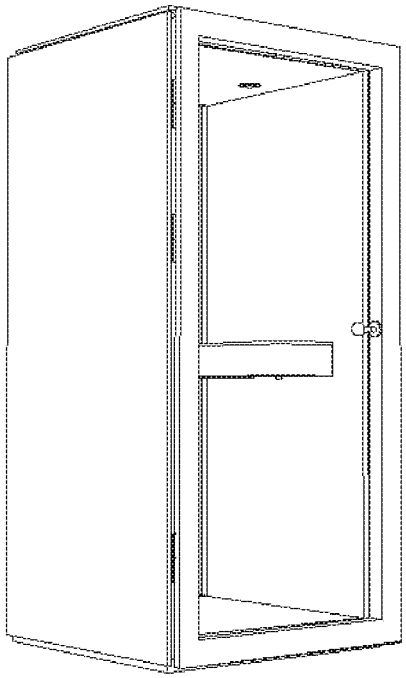
FIG. 12 is a structural diagram in which the door assembly is a glass module provided by the present utility model.
Figure 13:
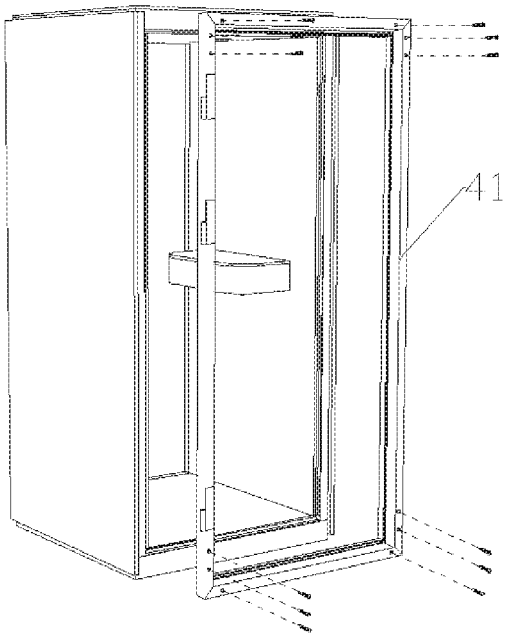
FIG. 13 is a detailed structural diagram in which the door assembly is a glass module provided by the present utility model.

Specifically, referring to FIG. 12 and FIG. 13, the door assembly 4 mainly comprises a door frame 41 in which the glass module 38 is installed. Whether the mobile space is in use or not can be directly seen from the glass module 38, thereby satisfying different demands of customers.

In one embodiment, a circle of tightly-spliced lock catches is arranged on the door frame 41. Tightly-spliced lock catch members which are matched with the tightly-spliced lock catches are arranged on glass, such that the glass is installed on the main frame.

In one embodiment, referring to FIG. 13, a circle of threaded holes is formed in the door frame 41. The glass module 38 is provided with corresponding threaded holes, such that the glass module 38 is installed on the door frame 41 through screws.

In an embodiment, a sound absorption component is arranged on at least one of the wall modules 3.

Specifically, the wall module 3 mainly comprises a main wall. The sound absorption component is installed on the inner side of the main wall, and is a sound absorption felt which can be used not only for sound insulation but also as an interior decorative finish of the wall module 3, to decorate the interior of the small mobile space and make it beautiful.

Figure 15:
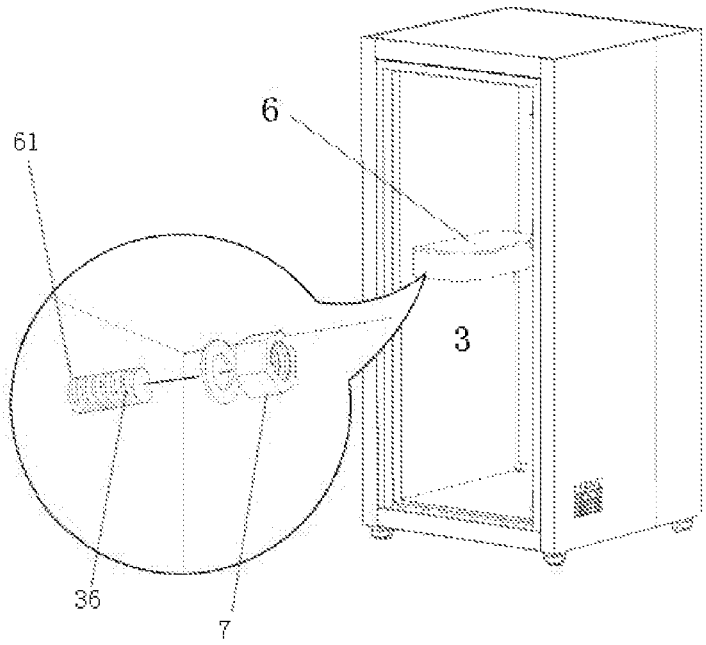
FIG. 15 is a schematic diagram in which a wall module is connected to a table provided by the present utility model.
Figure 16:
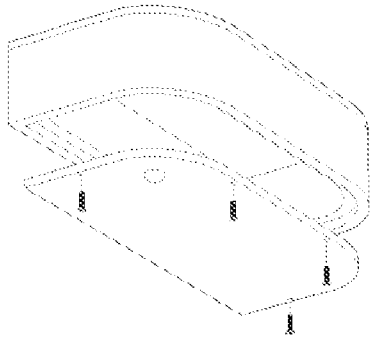
FIG. 16 is a schematic diagram of the table provided by the present utility model.

FIG. 15 is a schematic diagram in which the wall module is connected to the table provided by the present utility model. FIG. 16 is a schematic diagram of the table provided by the present utility model.

In an embodiment, the small mobile space further comprises a table 6 in which a first circuit system and a power socket are arranged. The table 6 is detectably connected to at least one of the wall modules 3. A mains supply is respectively connected to the first circuit system and the power socket. The first circuit system converts the mains supply to a DC of 12 v.

Specifically, referring to FIG. 15, the table 6 is provided with an installing hole 61. A bolt 36 which is matched with the installing hole 61 is prefabricated on the wall module 3. Therefore, the table 6 and the wall module 3 are connected and are fastened with a nut 7. However, the present disclosure is not limited thereto, and other connecting components may be used for connection, such as buckling, bonding, and the like.

In an embodiment, the first circuit system and the power socket are arranged inside at least one of the wall modules 3. The mains supply is respectively connected to the first circuit system and the power socket. The first circuit system converts the mains supply to a DC of 12 v.

Specifically, in this embodiment, the mains supply, the first circuit system, and the power socket are all integrated on the wall module 3.

In an embodiment, a second circuit system is further arranged inside at least one of the wall modules 3. One end of the second circuit system is connected to the first circuit system, and the other end of the second circuit system is arranged in the top plate 1 so as to supply the converted DC of 12 v to a lighting device 15 and the air inlet module in the top plate 1.

In an embodiment, the small mobile space further comprises an induction switch. The induction switch is arranged on at least one of the wall modules 3 or the table 6, and is connected to the second circuit system to switch on or switch off the second circuit system.

In one embodiment, the induction switch includes but is not limited to a human body sensor.

Specifically, referring to FIG. 16, a base plate of the table 6 is detachable. The induction switch and the first circuit system are arranged on the base plate. The mains supply enters the accommodating space along the through hole in the wall module 3. The mains supply has two ends, one end of which is connected to the power socket in the table 6, and the other end of which is connected to the first circuit system of the table 6. The mains supply is converted to a 12 v power supply in the table 6 through an AC power male and female plug, and then connected to the second circuit system of the wall module 3 through a male and female wiring terminal. The second circuit system of the wall module 3 is connected to the lighting device 15 and the air inlet module in the top plate 1. Thus, the electricity used by the lighting device 15 and the air inlet module in the top plate 1 is a DC of 12 v.

Specifically, in the present utility model, the maintenance of the circuit systems can be performed after the decorative plate 5, or the top plate 1 and the decorative finish on the inner side of the wall module 3 are disassembled.

The present disclosure aims to claim a small mobile space. The small mobile space comprises a top plate 1, a bottom plate 2, and a plurality of wall modules 3 which is arranged between the top plate 1 and the bottom plate 2 and which is connected in sequence. The top plate 1, the bottom plate 2 and the plurality of wall modules 3 jointly define an accommodating space. A door assembly 4 is arranged on at least one of the wall modules 3. A joint between every two adjacent wall modules 3, a joint between each wall module 3 and the top plate 1, as well as a joint between the bottom plate 2 and each of the plurality of wall modules 3 are clamped respectively by using a concave-convex structure. An air inlet module is arranged in the top plate 1. The air inlet module comprises an air inlet channel 11 having a preset length, and a sound absorption component arranged in the air inlet channel 11. An air inlet 12 of the air inlet channel is communicated to the outside. An air outlet 13 of the air inlet channel is communicated with the accommodating space. A mobile assembly 21 is arranged on the bottom plate 2, such that the accommodating space is movable and can be fixed at a preset position. The concave-convex groove is adopted at the joint between the walls, such that a path through which sound passes is longer, accompanied with good sealability. The inlet air channel has a longer path, so that sound cannot penetrate easily. In addition, the air inlet channel is further filled with a sound absorption material, thereby improving the sound insulation of a top module. The air outlet channel is set to have a lateral path, and the lateral air outlet channel increases the length of sound propagation and the number of sound wave reflections so as to weaken the sound. Meanwhile, the air outlet channel is also filled with the sound absorption material for secondary weakening of the sound. A sound absorption felt is further arranged in each wall to maximize the sound insulation. Various modules in the small mobile space of the present disclosure are prefabricated in a factory, thereby implementing modular installation, saving the installation time of a customer and reducing the installation difficulty. Meanwhile, the small mobile space is also convenient to disassemble and assemble, and is flat and firm. The decorative finish is replaceable and recyclable.

It should be understood that the above-described embodiments of the present disclosure are intended to exemplarily describe or explain the concept of the present disclosure merely and do not constitute a limitation to the present utility model. Therefore, any modifications, equivalent replacements, improvements, etc., which are made without departing from the spirit and scope of the present utility model, should be included within the protection scope of the present utility model. Moreover, the claims of the present disclosure are intended to encompass all the variations and modifications falling within the scope and boundary of the attached claims, or within equivalent forms of such scope and boundary.

The invention claimed is:

1. A small mobile space, comprising:

a top plate (1);

a bottom plate (2); and a plurality of wall modules (3) which are arranged between the top plate (1) and the bottom plate (2) and are connected in sequence, wherein the top plate (1), the bottom plate (2) and the plurality of wall modules (3) jointly define an accommodating space;

a door assembly (4) is arranged on at least one of the wall modules (3);

a joint between every two adjacent wall modules (3), a joint between each wall module (3) and the top plate (1), as well as a joint between the bottom plate (2) and each of the plurality of wall modules (3) are clamped respectively by using a groove (91) and a bulge (92);

an air inlet module is arranged in the top plate (1), and comprises an air inlet channel (11) having a preset length, and a sound absorption component arranged in the air inlet channel (11); an air inlet (12) of the air inlet channel is communicated to the outside; an air outlet (13) of the air inlet channel is communicated with the accommodating space;

an air outlet module is arranged on at least one of the wall modules (3), the air outlet module comprises an air outlet channel (31) having a preset length, and a sound absorption component arranged in the air outlet channel (31); and an air inlet (32) of the air outlet channel is communicated with the accommodating space, and an air outlet (33) of the air outlet channel is communicated to the outside;

the air outlet channel (31) is laterally arranged in the wall module (3), an air inlet (32) of the air outlet channel and an air outlet (33) of the air outlet channel are spaced apart by a predetermined distance in a width direction; and a mobile assembly (21) is arranged on the bottom plate (2), such that the accommodating space is movable and can be fixed at a preset position.

2. The small mobile space according to claim 1, wherein the groove (91) is formed in one side, close to the top plate (1), of the wall module (3), and the bulge (92) whose shape is matched with that of the groove (91) is arranged on the top plate (1);

the groove (91) is formed in one side, close to the bottom plate (2), of the wall module (3), and the bulge (92) whose shape is matched with that of the groove (91) is arranged on the bottom plate (2); and for every two adjacent wall modules (3), the groove (91) is formed in one of the two adjacent wall modules (3), and the bulge (92) whose shape is matched with that of the groove (91) is arranged on the other wall module (3).

3. The small mobile space according to claim 1, wherein the air inlet module further comprises:

an air supply component (14) which is arranged at the air inlet (12) of the air inlet channel to suck outside air into the air inlet channel (11).

4. The small mobile space according to claim 1, wherein the air outlet channel (31) extends in a width direction of the wall module (3); or the air outlet channel (31) extends in a height direction of the wall module (3).

5. The small mobile space according to claim 1, wherein a corner post (22) is arranged at a corner position of the bottom plate (2);

an insertion slot (34) whose shape is matched with that of the corner post (22) is formed at a joint between the wall module (3) and the corner post (22); and the insertion slot (34) cooperates with the corner post (22), such that the wall module (3) is in inserted connection with the bottom plate (2).

6. The small mobile space according to claim 1, wherein at least one detachable decorative plate (5) is arranged on the outer side of the top plate (1);

at least one detachable decorative plate (5) is installed on the outer side of at least one of the wall modules (3), which is not provided with the door assembly (4); and at least one detachable decorative plate (5) is arranged on the outer side of the door assembly (4).

7. The small mobile space according to claim 6, wherein at least one elastic connector (37) is arranged on the outer side of the wall module (3), wherein one end, close to the elastic connector, of the decorative plate (5) is configured as a folded structure (51), and the folded structure (51) is inserted into the elastic connector (37), the elastic connector (37) elastically contracts.

8. The small mobile space according to claim 6, wherein at least one locking hole is formed in the outer side of the plurality of wall module (3), and a lock catch which is matched with the locking hole is arranged on one side, close to the plurality of wall module (3), of the decorative plate (5); or at least one lock catch is arranged on the outer side of the plurality of wall module (3), and a locking hole which is matched with the lock catch is formed in one side, close to the plurality of wall module (3), of the decorative plate (5).

9. The small mobile space according to claim 6, further comprising a connector, wherein at least one locking hole (35) is formed on the wall module (3), and a decorative plate locking hole which corresponds to the locking hole is formed in one side, close to the wall module (3), of the decorative plate (5); and the connector passes through the locking hole and the decorative plate locking hole in sequence to detachably connect the wall module (3) and the decorative plate (5).

10. The small mobile space according to claim 1, wherein at least one detachable decorative finish (8) is arranged on the inner side of the top plate (1);

at least one detachable decorative finish (8) is installed on the inner side of at least one of the wall modules (3), which is not provided with the door assembly (4); and at least one detachable decorative plate (8) is arranged on the inner side of the door assembly (4).

11. The small mobile space according to claim 1, wherein a glass module is arranged on at least one of the wall modules (3).

12. The small mobile space according to claim 1, wherein a sound absorption component is arranged on at least one of the wall modules (3).

13. The small mobile space according to claim 1, wherein a first circuit system and a power socket are arranged inside at least one of the wall modules (3);

a mains supply is respectively connected to the first circuit system and the power socket; and the first circuit system converts the mains supply to a DC of 12 v.

14. The small mobile space according to claim 1, further comprising a table (6) in which a first circuit system and a power socket are arranged;

the table (6) is detachably connected to the at least one of the wall modules (3);

a mains supply is respectively connected to the first circuit system and the power socket; and the first circuit system converts the mains supply to a DC of 12 v.

15. The small mobile space according to claim 14, wherein a second circuit system is further arranged inside at least one of the wall modules (3); and one end of the second circuit system is connected to the first circuit system, and the other end of the second circuit system is arranged in the top plate (1) so as to supply the converted DC of 12 v to a lighting device (15) and the air inlet module in the top plate (1).

16. The small mobile space according to claim 15, further comprising an induction switch, wherein the induction switch is arranged on the at least one of the wall modules (3) or the table (6); and the induction switch is connected to the second circuit system so as to switch on or switch off the second circuit system.

* * * * *